US006619778B2

(12) United States Patent
Igarashi

(10) Patent No.: US 6,619,778 B2
(45) Date of Patent: Sep. 16, 2003

(54) CARRIAGE MOTOR CONTROL IN A PRINTER

(75) Inventor: Hitoshi Igarashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/209,973

(22) Filed: Aug. 2, 2002

(65) Prior Publication Data

US 2003/0043228 A1 Mar. 6, 2003

(30) Foreign Application Priority Data

Aug. 7, 2001 (JP) ..... 2001-239366

(51) Int. Cl.[7] ..... B41J 29/393
(52) U.S. Cl. ..... 347/19; 347/37
(58) Field of Search ..... 347/19, 37, 14, 347/5

(56) References Cited

U.S. PATENT DOCUMENTS 6,040,670 A * 3/2000 Kaneko et al. ..... 318/561
6,189,993 B1 * 2/2001 Mantell ..... 347/15

* cited by examiner

*Primary Examiner*—Lamson Nguyen
(74) *Attorney, Agent, or Firm*—Sughrue Mion, PLLC

(57) ABSTRACT

A control circuit 200 for a carriage motor 60 has a speed differential generation circuit 206. The speed differential generation circuit sets a speed differential ΔV at a constant value during a period $P_1$, and the constant speed differential ΔV is inputted to three operation elements 210, 212 and 214. Also, the speed differential generation element 206 uses the actual differential ($V_t$–$V_c$) as the speed differential ΔV after the period $P_1$.

15 Claims, 8 Drawing Sheets

FIRST EMBODIMENT
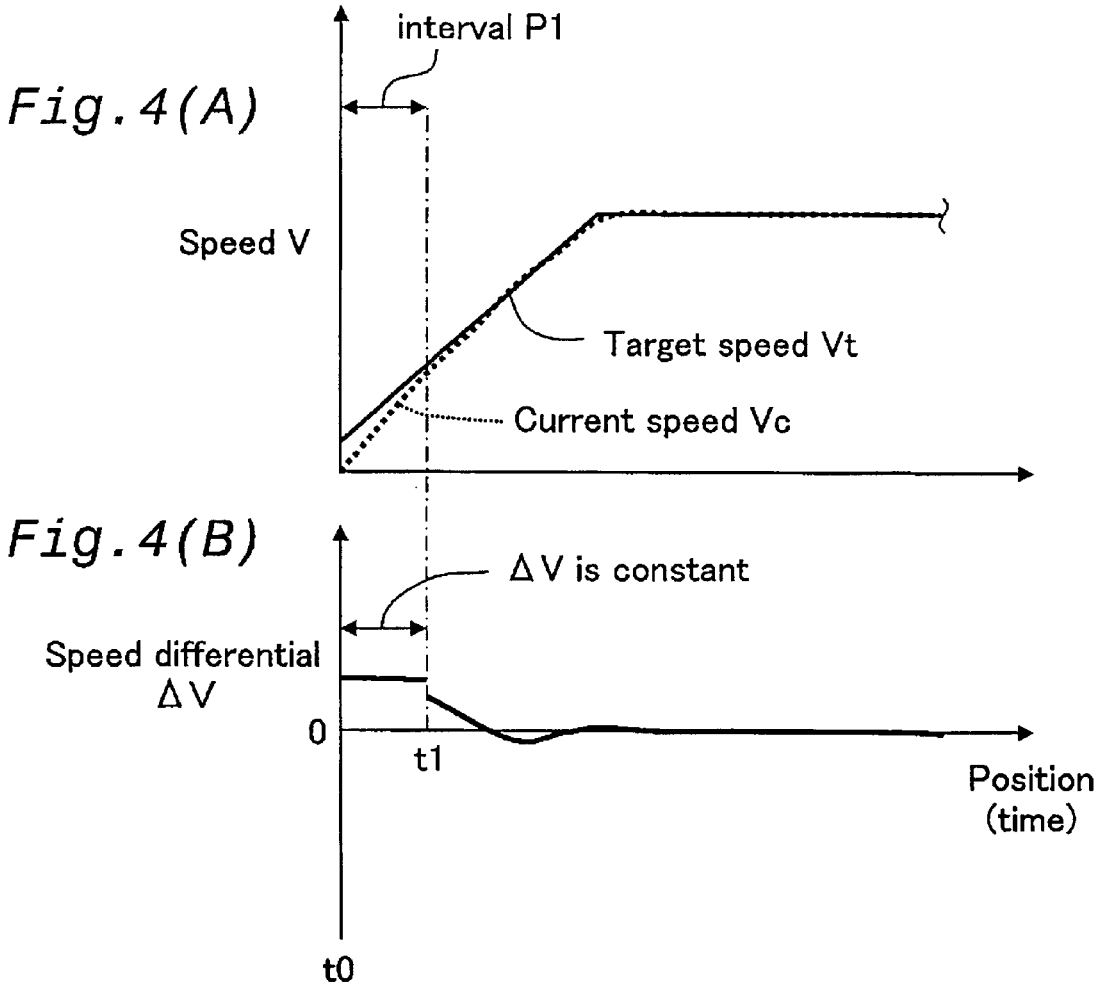
ΔV is set to a constant value during interval P1

SECOND EMBODIMENT

ΔV decreases linearly during interval P1

ENCODER OUTPUT SIGNALS
Fig.7(a) FORWARD ROTATION
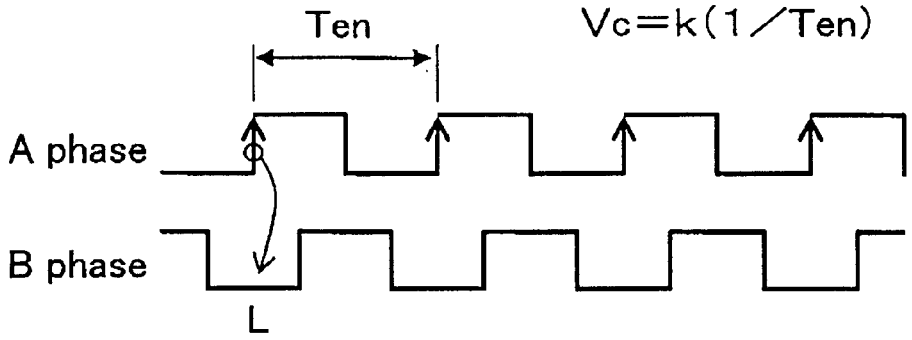
Fig.7(b) REVERSE ROTATION
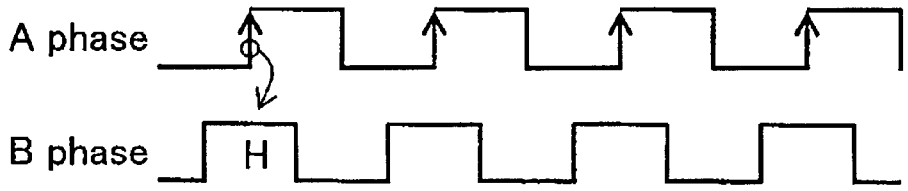

CARRIAGE MOTOR CONTROL IN A PRINTER

BACKGROUND OF THE INVENTION

1. Field of the Invention

The invention relates to a technology for controlling an operation of a carriage motor in a printer.

2. Description of the Related Art

An ink jet printer is provided with a carriage having a print head, a carriage motor for moving the carriage, and a drive control device for controlling the carriage motor. FIG. 6 is a block view showing the structure of a conventional drive control device. The drive control device has a control circuit 300, a drive circuit 320 and a carriage motor 330. The carriage motor 330 is provided with an encoder 332 for detecting the current speed $V_c$ of the carriage.

FIGS. 7(*a*) and 7(*b*) show output signals from the encoder 332 (hereinafter, referred to as an "encoder output signals"). A typical encoder output signal includes an A phase signal and a B phase signal. The direction of rotation (forward and reverse) of the carriage motor 330 is determined in response to the phaseal relationship of the A phase signal and the B phase signal. For example, if the A phase signal is rising while the B phase signal is at the L level, forward rotation is determined (FIG. 7(*a*)), and if the A phase signal is rising while the B phase signal is at the H level, reverse rotation is determined (FIG. 7(*b*)). The position of the carriage is determined in response to the direction of rotation of the carriage motor 330 and the number of pulses in the encoder output signal. Also, the current speed $V_c$ of the carriage is determined as a value proportional to the inverse of the cycle $T_{en}$ of the encoder output signal, that is, $Vc=(k/T_{en})$, where k is a constant.

The control circuit 300 includes a subtractor 302 for obtaining a differential $\Delta V$ between a target speed $V_t$ and current speed $V_c$, a proportional element 304, an integral element 306, a derivative element 308 and an adder 310. The three operation elements 304, 306 and 308 output operation results in response to the speed differential $\Delta V$, and the operation results are then summed by the adder 310. A summed result $\Sigma Q$ is supplied to the drive circuit 320 as a control signal. The drive circuit 320 supplies a drive signal $S_{dr}$ in response to the control signal $\Sigma Q$ to the carriage motor 330.

The control circuit 300 having PID control functions can control the speed and position of the carriage motor 330 with high precision. Due to various reasons, however, so-called hunting may occur.

FIGS. 8(A) and 8(B) show the hunting occurred in the speed V and the speed differential $\Delta V$. The abscissa in FIG. 8(A) is the position (or time) and the ordinate is the speed V. The ordinate in FIG. 8(B) is the speed differential $\Delta V$. The target speed $V_t$ is set beforehand in response to the difference between the target position and the current position of the carriage. In the example of FIG. 8(B), hunting occurs such that the speed differential $\Delta V$ fluctuates both positively and negatively. The cause of such hunting is, for example, that the cycle $T_{en}$ of the encoder output signal is unstable when the motor 330 begins to move, resulting in instability of the measured value of the current speed $V_c(=k/T_{en})$.

In a printer wherein ink is ejected from a print head with a carriage, printing is carried out by ejecting ink from the print head while the carriage is moving at a constant speed. Suppression of hunting and precise control of the speed of the carriage are thus strongly desired in such a printer.

SUMMARY OF THE INVENTION

Accordingly, an object thereof to provide a technology for improving the precision of speed control of the carriage in a printer.

In order to attain the above object of the present invention, there is provided a printer comprising a carriage having a print head; a carriage motor for moving the carriage; and a drive control device for controlling operation of the carriage motor. The drive control device includes: a drive circuit for driving the carriage motor; a detector for detecting a current speed of the carriage; a target speed generator for generating a target speed for the carriage; and a control section for generating a control signal supplied to the drive circuit in response to the target speed and the current speed of the carriage. The control section includes a plurality of operation elements including a proportional element and an integral element; a control signal generator for summing operation results from the plurality of operation elements to generate the control signal; and a speed differential generator for generating a speed differential to be inputted to the plurality of operation elements in response to the target speed and the current speed of the carriage. The speed differential generator generates the speed differential having a smaller range of change than an actual differential between the target speed and the current speed during a predetermined period immediately after the carriage begins to move, and supplies the speed differential to the plurality of operation elements.

The speed differential generator may generate the speed differential showing a predetermined pattern of change during the predetermined period.

In one embodiment, the speed differential generator generates the speed differential which maintains a constant value during the predetermined period.

In another embodiment, the speed differential generator generates the speed differential such that it monotonously decreases during the predetermined period.

The speed differential generator may use an actual differential between the target speed and the actual speed as the speed differential after the predetermined period.

These and other objects, features, aspects, and advantages of the present invention will become more apparent from the following detailed description of the preferred embodiments with the accompanying drawings.

BRIEF DESCRIPTION OF THE DRAWINGS

FIGS. 4(A) and 4(B) show the operation of the CR motor control circuit 200 in the first embodiment.

FIGS. 7(*a*) and 7(*b*) show an example of encoder output signals.

DESCRIPTION OF THE PREFERRED EMBODIMENT

Embodiments of the present invention are described below in the following sequence:

A. Overall structure of the device

B. Various embodiments of the control method

C. Modified embodiments

A. Overall Structure of the Device

Figure 1:
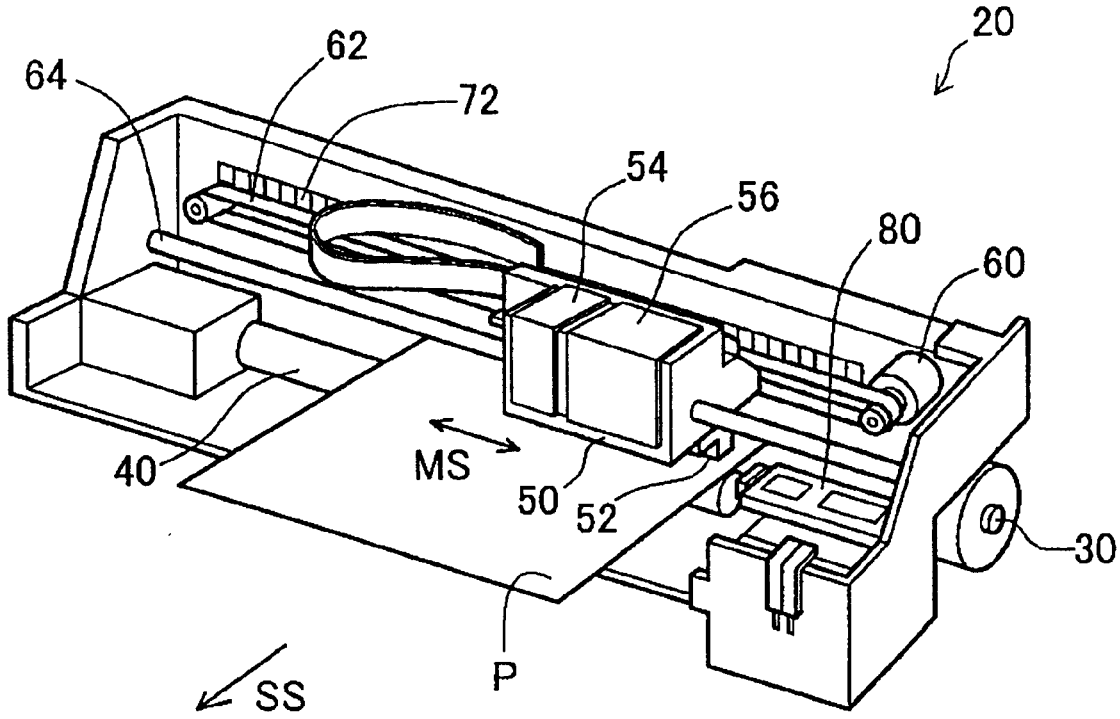
FIG. 1 is an outline perspective view showing a main structure of the ink jet printer 20 as an embodiment according to the present invention.

FIG. 1 is an perspective view showing the main structure of an inkjet printer 20 as an embodiment of the present invention. The printer 20 is equipped with a paper feed motor 30 for feeding printing paper P in a sub-scan direction SS, a platen 40, a carriage 50 having a print head 52, and a carriage motor 60 for moving the carriage 50 in a main scan direction MS. The carriage motor 60 is, for example, a DC motor with a brush.

The carriage 50 is pulled by a tractor belt 62 driven by the carriage motor 60, and moves along the guide rail 64. In addition to the print head 52, the carriage 50 is loaded with a black ink cartridge 54 and a color ink cartridge 56.

A capping device 80 is provided at the home position (the right hand position in FIG. 1) of the carriage 50 for sealing the nozzle surface of the print head 52 when stopped. When a print job is complete and the carriage 50 reaches the top of the capping device 80, the capping device 80 automatically rises due to a mechanism not illustrated, sealing the nozzle surface of the print head 52. This capping prevents the ink in the nozzle from drying. The positioning control of the carriage 50 is carried out to accurately position the carriage 50 above the capping device 80, for example.

Figure 2:
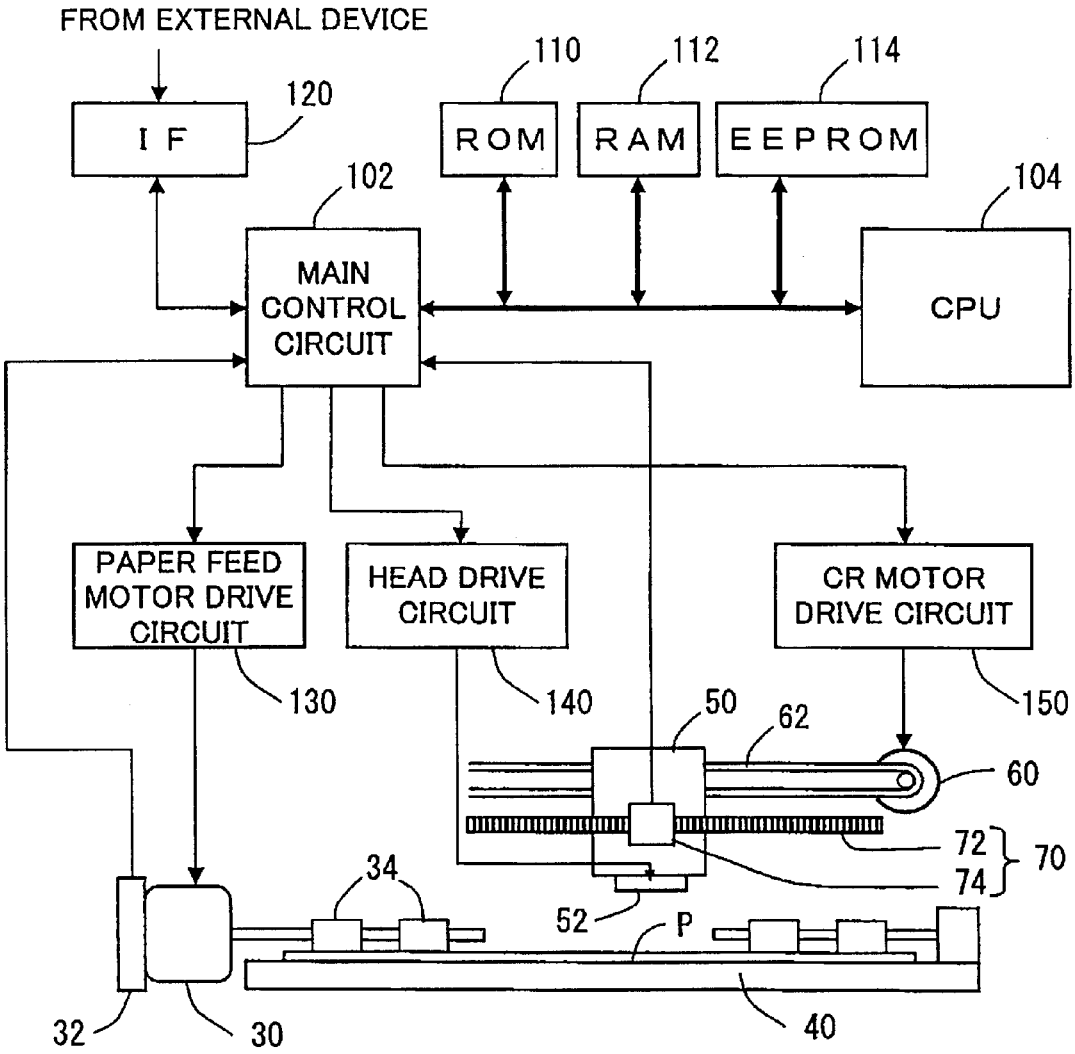
FIG. 2 is a block view showing an electrical structure of the printer 20.

FIG. 2 is a block view showing the electrical structure of the printer 20. The printer 20 is equipped with a main control circuit 102, a CPU 104, and various memories (ROM 110, RAM 112, and EEPROM 114) connected to the main control circuit 102 and the CPU 104 through a bus. The main control circuit 102 is coupled to an interface circuit 120 for sending and receiving signals with an external device such as a personal computer, a paper feed motor drive circuit 130, a head drive circuit 140 and a CR motor drive circuit 150.

The paper feed motor 30 is driven by the paper feed motor drive circuit 130 to rotate the paper feed roller 34, which moves the printing paper P in the sub-scan line direction. The paper feed motor 30 is provided with a rotary encoder 32, which supplies output signals to the main control circuit 102.

The bottom of the carriage 50 is provided with the print head 52 having a plurality of nozzles (not illustrated). Each nozzle ejects ink drops when driven by a head drive circuit 140.

The carriage motor 60 is driven by the CR motor drive circuit 150. The printer 20 is equipped with a linear encoder 70 for detecting the speed and the position along the main scan direction of the carriage 50. The linear encoder 70 comprises a linear scale plate 72 provided parallel to the main scan direction, and a photo sensor 74 provided at the carriage 50. Output signals from the linear encoder 70 are inputted to the main control circuit 102.

The main control circuit 102 has a function to supply control signals to each of three drive circuits 130, 140 and 150, as well as a function to carry out tasks such as decoding various print commands received by the interface 120, executing controls relating to the adjusting of print data, and monitoring various sensors. The CPU 104 has various functions to support the main control circuit 102 such as, for example, controlling various memories.

Figure 3:
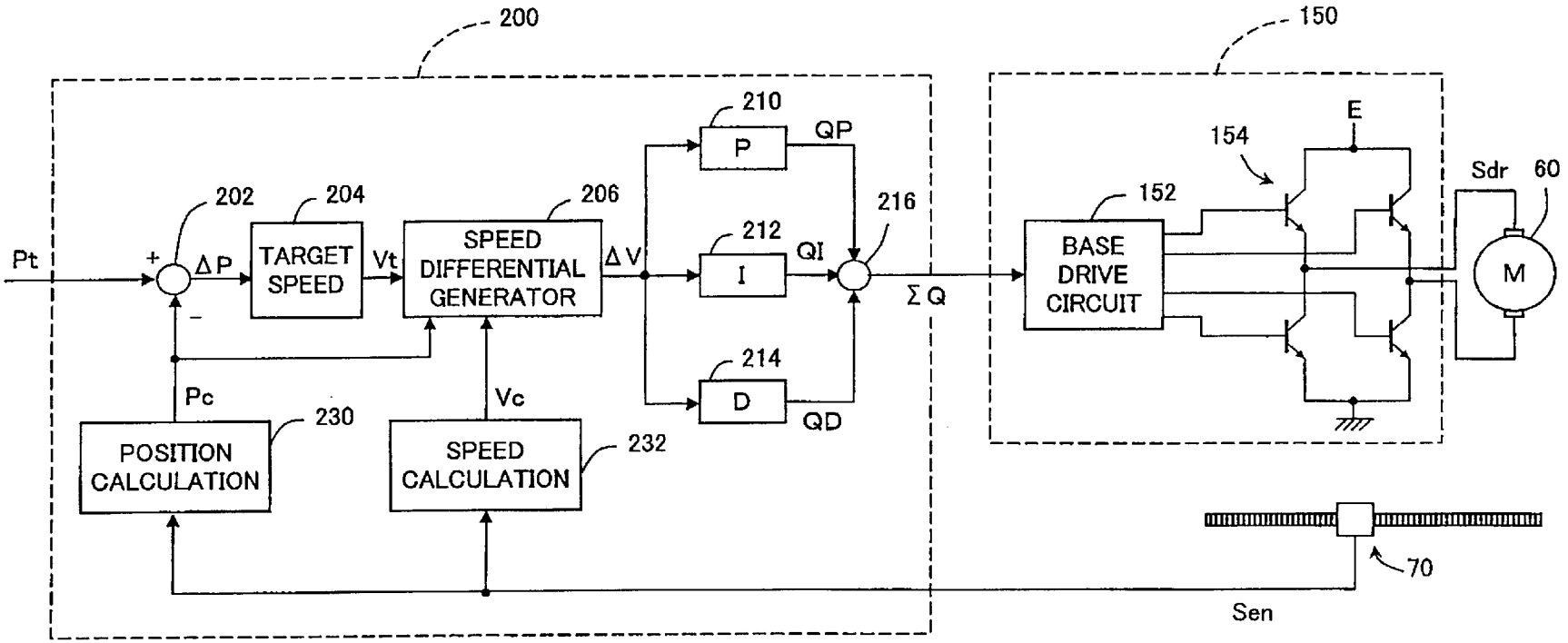
FIG. 3 is a block view showing the structure of the drive control device for the carriage motor 60.

FIG. 3 is a block view showing the structure of a drive control device for the carriage motor 60. The drive control device includes a CR motor control circuit 200 and a CR motor drive circuit 150. The CR motor control circuit 200 is part of the main control circuit 102 shown in FIG. 2.

Figure 8A:
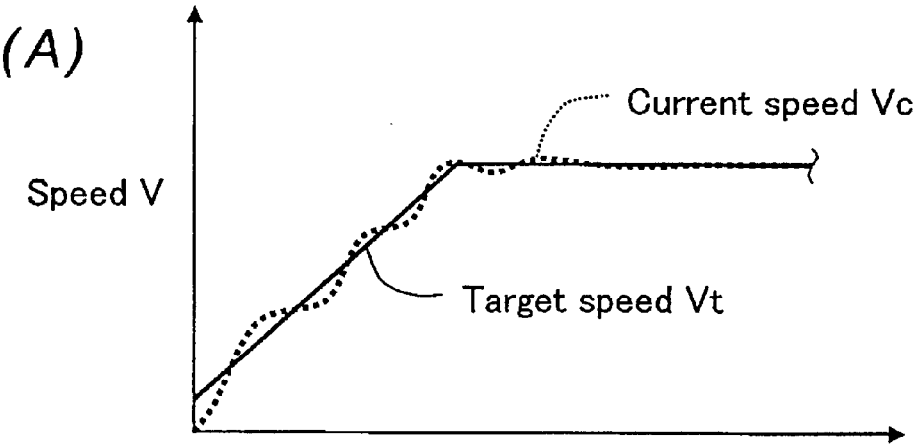
FIGS. 8(A) and 8(B) show an aspect of control in conventional technology.
Figure 8B:
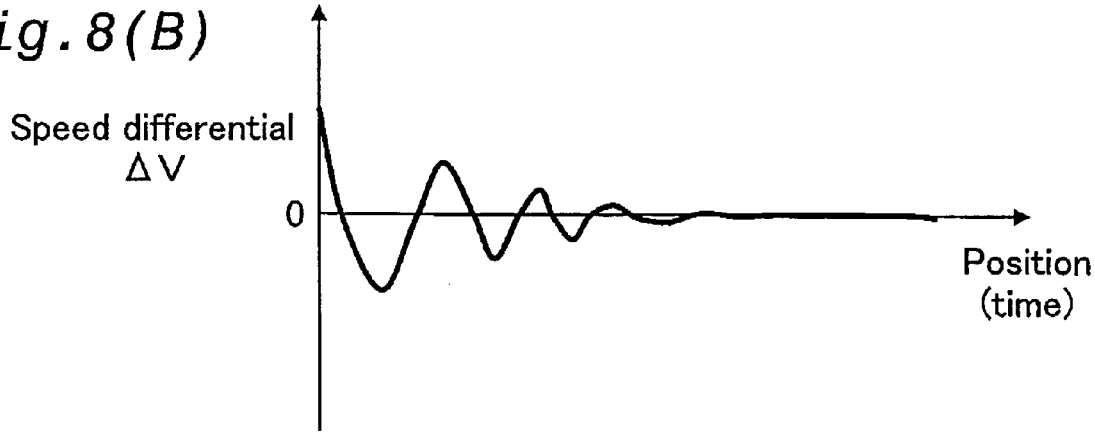

Output signals $S_{en}$ for the linear encoder 70 are inputted to a position calculation circuit 230 and a speed calculation circuit 232 in the CR motor control circuit 200. The circuits 230 and 232 use the A phase signal and B phase signal (not shown) of the output signals $S_{en}$ from the encoder 70 to obtain the current position $P_c$ and the current speed $V_c$ of the carriage. The subtractor 202 obtains the differential ΔP between the provided target position $P_t$ and the current position $P_c$ and supplies the differential ΔP to a target speed generation circuit 204. The target speed generation circuit 204 generates a target speed $V_t$ in response to the position differential ΔP. The changing pattern of the target speed $V_t$ is the same as that shown with the solid line in FIG. 8(A), for example.

A speed differential generation circuit 206 determines the speed differential ΔV from the target speed $V_t$ and the current speed $V_c$, and the result is inputted to a proportional element 210, an integral element 212 and a derivative element 214. The details of the processing to generate the speed differential ΔV will be described later. Operation results $Q_P$, $Q_I$ and $Q_D$ from the three operation elements 210, 212 and 214 are added by an adder 216 to calculate a summed result ΣQ.

The outputs $Q_P$, $Q_I$ and $Q_D$ from the respective operation elements 210, 212 and 214 as well as their summed result ΣQ are given by, for example, the following formulas (1) to (4).

$$Q_P(j)=\Delta V(j)\times Kp \tag{1}$$

$$Q_I(j)=Q_I(j-1)+\Delta V(j)\times K_i \tag{2}$$

$$Q_D(j)=(\Delta V(j)-\Delta V(j-1))\times K_d \tag{3}$$

$$\Sigma Q(j)=Q_P(j)+Qi(j)+Q_D(j) \tag{4}$$

where j represents the time, $K_p$ the proportional gain, $K_i$ the integral gain and $K_d$ the differential gain.

The summed result ΣQ (also referred to as a "PID output") is supplied to a CR motor drive circuit 150 as a control signal. A control signal adjustment circuit may be added after the adder 216 by which the level of the control signal provided to the CR motor drive circuit 150 is adjusted according to need.

The CR motor drive circuit 150 is provided with a DC DC converter 154 constituting a transistor bridge, and a base drive circuit 152. The base drive circuit 152 generates base signals which are applied to the base electrodes of the transistors of the DC DC converter 154 in response to the control signal ΣQ supplied by the CR motor control circuit 200. In response to the base signals, the DC DC converter 154 generates and supplies to the carriage motor 60 a motor drive signal $S_{dr}$.

B. Various Embodiments of the Control Method

FIG. 4 shows the operation of the CR motor control circuit 200 in the first embodiment. First, when the target position $P_t$ (FIG. 3) is inputted to the CR motor control circuit 200 at time $t_0$, the target speed generation circuit 204 generates a target speed $V_t$ in response to the differential $\Delta P(=P_t-P_c)$ between the target position $P_t$ and the current position $P_c$. In this manner, the carriage 50 begins to move at time $t_0$. The target speed $V_t$ is set beforehand in the target speed generation circuit 204 so that the target speed $V_t$ shows a predetermined change pattern in response to the differential ΔP $(=P_t-P_c)$ of the target position $P_t$ and the current position $P_c$.

During a period $P_1$ from time to $t_0$ to $t_1$, the speed differential generation circuit 206 sets the speed differential ΔV to a predetermined constant value as shown in FIG. 4(B), and inputs it to the three operation elements 210, 212 and 214. The value of the speed differential ΔV during the period $P_1$ is set beforehand regardless of the actual difference $(V_t-V_c)$ between the target speed $V_t$ and the current speed $V_c$. Alternatively, a value $C(V_t-V_c)$ found by multiplying a predetermined coefficient C to the actual differential $(V_t-V_c)$ at the time $t_0$ may be used as the value of the speed differential $\Delta V$ during period $P_1$.

Since the value of the speed differential $\Delta V$ inputted to each operation element 210, 212 and 214 is kept at a constant value during the period $P_1$, the value of the control signal $\Sigma Q$ does not greatly fluctuate. As described in the Related Art section, the output signals $S_{en}$ from the encoder 70 may be unstable when the carriage 50 begins to move, so that the current speed $V_c$ determined from the output signals $S_{en}$ readily changes. Even in such situations, the speed differential $\Delta V$ is held constant in the first embodiment, so it is possible to suppress the hunting of the actual carriage speed. It is also possible to prevent excess acceleration of the carriage 50.

In some cases, the carriage motor 60 reverses slightly when the carriage 50 begins to move due to a backlash of a gear train (not illustrated) provided at the carriage motor 60. In such cases as well, the speed differential $\Delta V$ is held during the period $P_1$ at a predetermined constant value in the first embodiment, giving the advantage of raising the carriage speed smoothly.

At time $t_1$ at the end of the period $P_1$, the speed differential generation circuit 206 uses the actual differential $(V_t-V_c)$ as the speed differential $\Delta V$, which is inputted to the three operation elements 210, 212 and 214. Since the carriage 50 does not excessively accelerate during the period $P_1$, it is possible to continue control of the speed and position of the carriage with good precision after the period $P_1$.

The length of the period $P_1$ is measured in response to the current position $P_c$ provided by the position calculation circuit 230 to the speed differential generation circuit 206. For example, it is possible to select a length of 2 to 5 cycles of encoder output signals $S_{en}$ (or 2 to 5 pulses) as the length of the period $P_1$. After the encoder output signal $S_{en}$ generates several pulses, the fluctuation in the cycle $T_{en}$ (FIG. 7(*a*)) of the encoder output signal $S_{en}$ decreases, as does that of the current speed $V_c$ $(=k/T_{en})$. Thus, if the interval during which the encoder output signal $S_{en}$ generates several pulses is set as the period $P_1$, the hunting can be adequately restrained. The length of the period $P_1$ may alternatively be regulated with an absolute time measured with a timer (not illustrated) regardless of the encoder output signal $S_{en}$.

As shown in FIG. 4(B), when the actual differential $(V_t-V_c)$ is selected at the time $t_1$, it is possible for the value of the speed differential $\Delta V$ to jump somewhat at the time $t_1$. There is usually not a problem in actuality even if there is some jump in the value of the speed differential $\Delta V$. It is favorable, however, that a jump does not occur in the speed differential $\Delta V$ at the time $t_1$. The value of the speed differential $\Delta V$ may be caused to change smoothly from the constant value during the period $P_1$ to the actual speed differential $(V_t-V_c)$ during a short transient interval after the time $t_1$. In the present Specification, the expression "to use an actual differential between the target speed and actual speed as the speed differential after the predetermined period $P_1$" has a broad meaning covering the case in which a transient value is used in a short transient interval after the predetermined period $P_1$.

As described above in the first embodiment, the speed differential $\Delta V$ is held at a constant value during the predetermined period $P_1$ after the carriage 50 begins to move, so the hunting in the actual carriage speed and the speed differential can be adequately suppressed. As a result, it is possible to improve the control precision for the carriage speed.

Figure 5A:
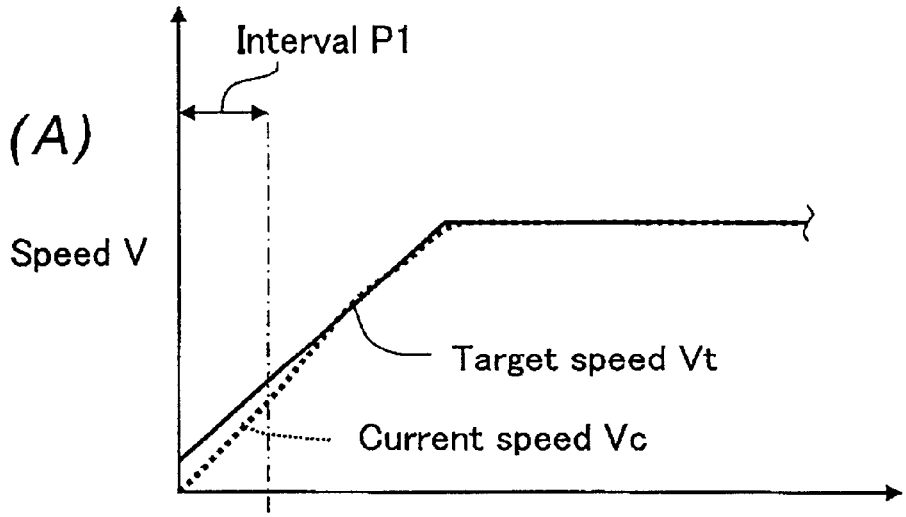
FIGS. 5(A) and 5(B) show the operation of a CR motor control circuit 200 in the second embodiment.
Figure 5B:
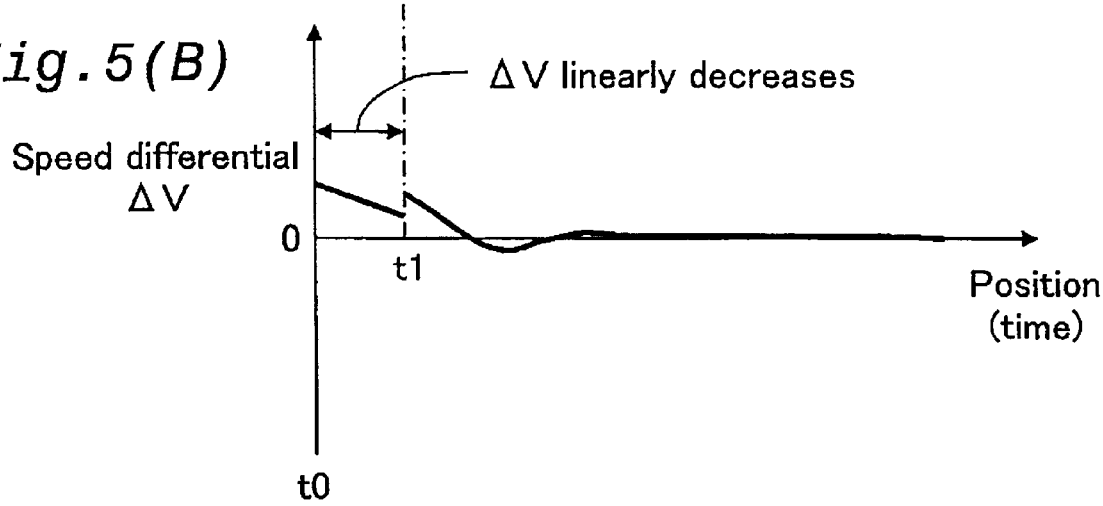
Figure 6:
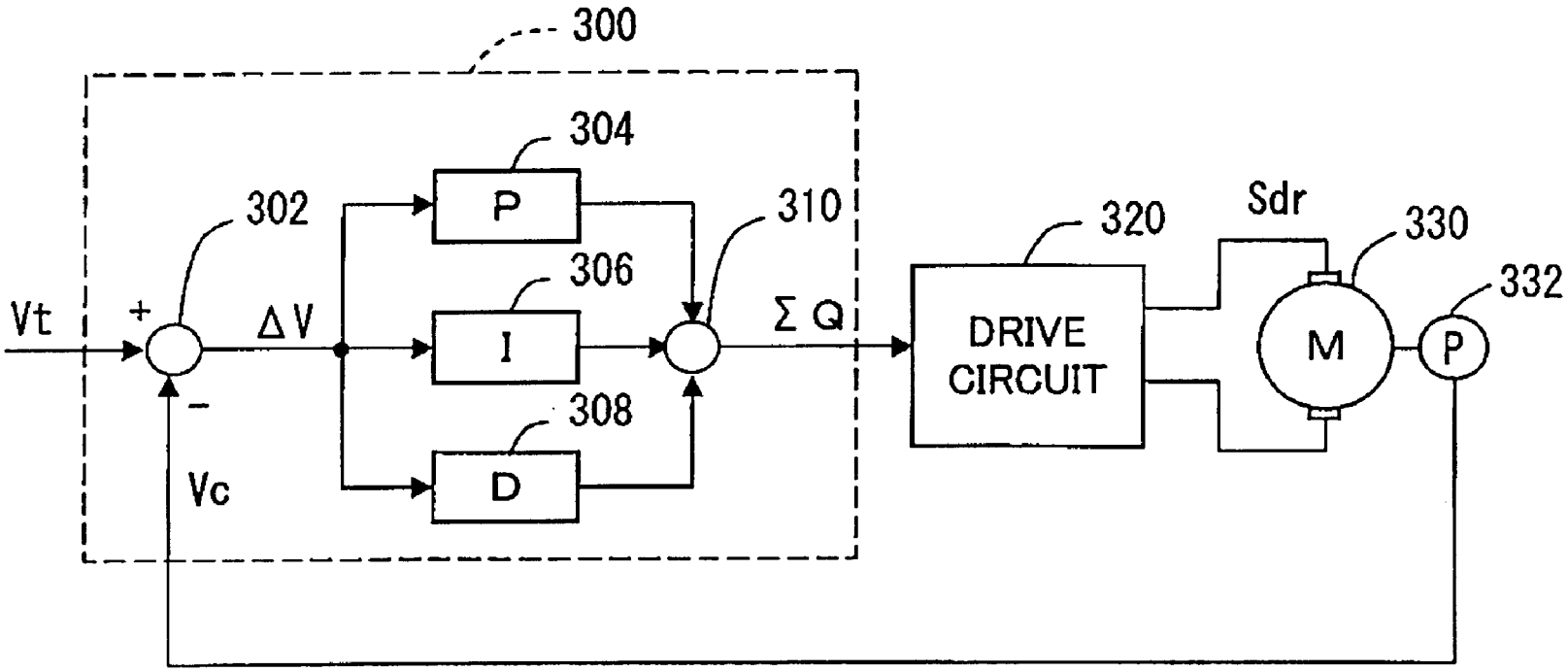
FIG. 6 is a block view showing the structure of a conventional drive control device.

FIGS. 5(A) and 5(B) show an operation of the CR motor control circuit 200 in the second embodiment according to the present invention. In the second embodiment, the speed differential generation circuit 206 generates a speed differential $\Delta V$ such that the speed differential $\Delta V$ linearly decreases during the period $P_1$. In this manner as well, the hunting in the actual carriage speed and speed differential can be suppressed as in the first embodiment, so the control precision can be improved.

Values of the speed differential $\Delta V$ at the times $t_0$ and $t_1$ may be set beforehand regardless of the actual differential $(V_t-V_c)$, or alternatively they may be determined by multiplying predetermined coefficients to the actual differential $(V_t-V_c)$ at the time $t_0$ and $t_1$, respectively.

Rather than decreasing the speed differential $\Delta V$ linearly in the second embodiment, it may be decreased curvilinearly. More specifically, the speed differential $\Delta V$ may be monotonously decreased during the period $P_1$. If the speed differential $\Delta V$ is monotonously decreased during the period $P_1$, smoother control is possible both during and after the period $P_1$.

Change in the speed differential $\Delta V$ during the period $P_1$ may be set to various predetermined patterns of change other than those described above. Also, in general, the speed differential generation circuit 206 may generate a speed differential $\Delta V$ having a smaller range of change than the actual differential $(V_t-V_c)$ between the target speed $V_t$ and the current speed $V_c$ during the predetermined period $P_1$, and input that speed differential $\Delta V$ to the plurality of operation elements 210, 212 and 214. For example, the value found by multiplying a coefficient less than 1 to the actual differential $(V_t-V_c)$ may be inputted as the speed differential $\Delta V$ to the operation elements 210, 212 and 214. This operation suppresses the hunting, and improves the control precision.

C. Modified Embodiments

C1. Modified Embodiment 1

A brushless DC motor or an AC motor may be also used as the carriage motor 60. Also, the present invention is applicable to controlling motors other than those for printer carriages.

C2. Modified Embodiment 2

Part of the hardware circuitry may be replaced with software in the above mentioned embodiments, and as well, part of the functions implemented by software may be replaced with hardware circuitry. For example, a part or the entirety of the function of the control circuit 200 (FIG. 3), for example, may be implemented with a computer program.

C3. Modified Embodiment 3

In the embodiments described above, the hunting is suppressed by adjusting the speed differential $\Delta V$ during the period $P_1$; but instead, the hunting may be suppressed by adjusting the level of the control signal $\Sigma Q$ supplied from the operation elements 210, 212 and 214 to the CR motor drive circuit 150. For example, the maximum value $Q_{Pmax}$ may be set during the period $P_1$ to a proportional output $Q_P$. The value of the proportional output $Q_P$ will thus be restricted to the maximum value $Q_{Pmax}$ even if the actual speed differential $(V_t-V_c)$ grows large, so no excessively large signals will be output as the control signal $\Sigma Q$. It is thus possible to suppress the hunting.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer comprising a carriage having a print head;

a carriage motor for moving the carriage; and a drive control device for controlling operation of the carriage motor, the drive control device including:

a drive circuit for driving the carriage motor;

a detector for detecting a current speed of the carriage;

a target speed generator for generating a target speed for the carriage; and a control section for generating a control signal supplied to the drive circuit in response to the target speed and the current speed of the carriage, and wherein the control section includes:

a plurality of operation elements including a proportional element and an integral element;

a control signal generator for summing operation results from the plurality of operation elements to generate the control signal; and a speed differential generator for generating a speed differential to be inputted to the plurality of operation elements in response to the target speed and the current speed of the carriage, and wherein the speed differential generator generates the speed differential having a smaller range of change than an actual differential between the target speed and the current speed during a predetermined period immediately after the carriage begins to move, and supplies the speed differential to the plurality of operation elements.

2. A printer according to claim 1, wherein the speed differential generator generates the speed differential showing a predetermined pattern of change during the predetermined period.

3. A printer according to claim 2, wherein the speed differential generator generates the speed differential which maintains a constant value during the predetermined period.

4. A printer according to claim 2, wherein the speed differential generator generates the speed differential such that it monotonously decreases during the predetermined period.

5. A printer according to claim 1, wherein the speed differential generator uses an actual differential between the target speed and the actual speed as the speed differential after the predetermined period.

6. A drive control device, for use in a printer comprising a carriage with a print head and a carriage motor for moving the carriage, for controlling operation of the carriage motor, the derive control device comprising:

a drive circuit for driving a carriage motor for moving a carriage;

a detector for detecting a current speed of the carriage;

a target speed generator for generating a target speed for the carriage; and a control section for generating a control signal supplied to the drive circuit in response to the target speed and the current speed of the carriage, the control section including:

a plurality of operation elements including a proportional element and an integral element;

a control signal generator for summing operation results from the plurality of operation elements to generate the control signal; and a speed differential generator for generating a speed differential to be inputted to the plurality of operation elements in response to the target speed and the current speed of the carriage, and wherein the speed differential generator generates the speed differential having a smaller range of change than an actual differential between the target speed and the current speed during a predetermined period immediately after the carriage begins to move, and supplies the speed differential to the plurality of operation elements.

7. A drive control device according to claim 6, wherein the speed differential generator generates the speed differential showing a predetermined pattern of change during the predetermined period.

8. A drive control device according to claim 7, wherein the speed differential generator generates the speed differential which maintains a constant value during the predetermined period.

9. A drive control device according to claim 7, wherein the speed differential generator generates the speed differential such that it monotonously decreases during the predetermined period.

10. A drive control device according to claim 6, wherein the speed differential generator uses an actual differential between the target speed and the actual speed as the speed differential after the predetermined period.

11. A method for controlling a carriage motor which moves a carriage having a print head, comprising the steps of:

(a) detecting a current speed of a carriage;

(b) generating a target speed of the carriage; and (c) generating a control signal to be supplied to a drive circuit of the carriage motor in response to the target speed and the current speed of the carriage, wherein the step (c) includes the steps of:

(d) generating a speed differential in response to the target speed and the current speed of the carriage;

(e) finding a plurality of operation results in response to the speed differential using a plurality of operation elements including a proportional element and an integral element; and (f) adding operation results from the plurality of operation elements to generate the control signal; and wherein the step (d) includes the step of generating a speed differential with a smaller range of change than an actual differential between the target speed and the current speed during a predetermined period immediately after the carriage begins to move.

12. A method according to claim 11, wherein the speed differential is generated such that the it shows a predetermined pattern of change during the predetermined period.

13. A method according to claim 12, wherein the speed differential is generated such that it maintains a constant value during the predetermined period.

14. A method according to claim 12, wherein the speed differential is generated such that it monotonously decreases during the predetermined period.

15. A method according to claim 11, wherein the step (d) further comprising the step of using an actual differential between the target speed and the actual speed as the speed differential after the predetermined period.

* * * * *